US009175656B2

(12) United States Patent
Kobayashi

(10) Patent No.: US 9,175,656 B2
(45) Date of Patent: Nov. 3, 2015

(54) FUEL INJECTION VALVE

(75) Inventor: Tatsuo Kobayashi, Susono (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 13/884,839

(22) PCT Filed: Dec. 20, 2010

(86) PCT No.: PCT/JP2010/072941

§ 371 (c)(1),
(2), (4) Date: May 10, 2013

(87) PCT Pub. No.: WO2012/086006

PCT Pub. Date: Jun. 28, 2012

(65) Prior Publication Data

US 2013/0233946 A1 Sep. 12, 2013

(51) Int. Cl.

| | |
|---|---|
| ***B05B 1/30*** | (2006.01) |
| ***F02M 51/00*** | (2006.01) |
| ***B05B 7/10*** | (2006.01) |
| ***F02M 61/16*** | (2006.01) |
| ***F02M 61/18*** | (2006.01) |

(Continued)

(52) U.S. Cl.

CPC ..... *F02M 61/162* (2013.01); *F02M 61/163* (2013.01); *F02M 61/182* (2013.01); *F02M 67/04* (2013.01); *F02M 69/047* (2013.01)

(58) Field of Classification Search

CPC .. F02M 61/162; F02M 61/163; F02M 69/047
USPC ..... 239/487, 488, 575, 590, 590.3, DIG. 23, 239/419.5, 428.5, 585, 533
See application file for complete search history.

(56) References Cited

U.S. PATENT DOCUMENTS 5,707,012 A * 1/1998 Maier et al. ..... 239/575
6,145,496 A * 11/2000 Pace et al. ..... 123/531

(Continued)

FOREIGN PATENT DOCUMENTS

JP 6199669 6/1986
JP 08-061189 A 3/1996

(Continued)

OTHER PUBLICATIONS

Chinese Office Action issued Apr. 25, 2014 in Chinese Patent Application No. 201080070759.7.

*Primary Examiner* — Len Tran
*Assistant Examiner* — Alexander Valvis
(74) *Attorney, Agent, or Firm* — Sughrue Mion, PLLC

(57) ABSTRACT

A fuel injection valve includes a nozzle body including an injection aperture; a needle that is slidably located in the nozzle body, forms a fuel introduction path between the needle and the nozzle body, and is seated on a seat portion in the nozzle body; a swirling flow generating portion that is located more upstream than the seat portion, and imparts a swirl with respect to a sliding direction of the needle to fuel introduced from the fuel introduction path; a swirl velocity increasing portion that is located more downstream than the seat portion, and increases a swirl velocity of a swirling flow generated in the swirling flow generating portion; and an air bubble reserving portion that is located more downstream than the swirl velocity increasing portion, and reserves air bubbles generated by passage through the swirl velocity increasing portion. The injection aperture opens in the air bubble reserving portion.

11 Claims, 9 Drawing Sheets

(51) Int. Cl.
*F02M 69/04* (2006.01)
*F02M 67/04* (2006.01)

(56) References Cited

U.S. PATENT DOCUMENTS

| | | | | |
|---|---|---|---|---|
| 6,966,499 | B2 * | 11/2005 | Nally et al. | 239/5 |
| 7,014,129 | B2 * | 3/2006 | Dantes et al. | 239/533.2 |
| 7,926,282 | B2 * | 4/2011 | Chew et al. | 60/748 |
| 8,052,073 | B2 * | 11/2011 | Kitagawa et al. | 239/533.11 |
| 2003/0019465 | A1 | 1/2003 | Heyse | |
| 2006/0131447 | A1 | 6/2006 | Masuda et al. | |
| 2008/0185460 | A1 * | 8/2008 | Onishi et al. | 239/584 |

FOREIGN PATENT DOCUMENTS

| | | | |
|---|---|---|---|
| JP | 10-141183 | A | 5/1998 |
| JP | 10-184497 | A | 7/1998 |
| JP | 10-331745 | A | 12/1998 |
| JP | 2000-230466 | A | 8/2000 |
| JP | 2003-307165 | A | 10/2003 |
| JP | 2004-019606 | A | 1/2004 |
| JP | 2004-506138 | A | 2/2004 |
| JP | 2005-113889 | A | 4/2005 |
| JP | 2006-177174 | A | 7/2006 |
| WO | 98/42979 | A1 | 10/1998 |

* cited by examiner

FUEL INJECTION VALVE

CROSS REFERENCE TO RELATED APPLICATIONS

This application is a National Stage of International Application No. PCT/JP2010/072941 filed Dec. 20, 2010, the contents of all of which are incorporated herein by reference in their entirety.

TECHNICAL FIELD

The present invention relates to a fuel injection valve.

BACKGROUND ART

In recent years, to reduce $CO_2$ and emissions, there has been an increase in research relating to internal-combustion engines into supercharged lean, a large amount EGR, and premixed self-ignition combustion. According to the research, a stable combustion state near the combustion limit is required in order to reduce $CO_2$ and emissions most effectively. In addition, while petroleum-based fuel dwindles, the robustness that allows stable combustion even with various fuel such as biofuel is required. The most important point to achieve such stable combustion is to reduce variations in ignition timing of an air-fuel mixture and smooth combustion that burns out the fuel during an expansion stroke.

In addition, an in-cylinder injection system that directly injects fuel into a combustion chamber is employed for a fuel supply in internal-combustion engines to improve transient responsiveness, improve volumetric efficiency by a latent heat of vaporization, and achieve significantly-retarded combustion for catalyst activation at low temperature. However, adoption of the in-cylinder injection system promotes combustion fluctuation due to oil dilution caused by crash of sprayed fuel against a combustion chamber wall with remaining droplet and degradation in fuel atomization due to deposits produced around an injection aperture of an injection valve by liquid fuel.

To prevent such oil dilution and degradation in fuel atomization caused by adoption of the in-cylinder injection system and reduce a variation in ignition timing to achieve stable combustion, it is important to atomize fuel spray so that the fuel in the combustion chamber smoothly vaporizes.

As a method of atomizing the fuel spray injected from a fuel injection valve, there has been known a method using a shear force of a thinned liquid film or cavitation occurring by separation of a flow, or atomizing fuel adhering to a surface by mechanical vibration of ultrasonic waves.

Patent Document 1 discloses a fuel injection nozzle that causes the fuel passing through a spiral passage formed between a wall surface of a hollow hole in a nozzle body and a sliding surface of a needle valve to be a rotating flow in a fuel basin that is a circular chamber. This fuel injection nozzle injects the fuel rotating in the fuel basin from a single injection aperture that is located downstream of the fuel basin and has a divergent tapered surface. The injected fuel is dispersed, and mixing with air is promoted.

Patent Document 2 discloses a fuel injection valve that injects fuel mixed with air bubbles generated by a difference between pressures in an air bubble generating passage and an air bubble retaining passage, and atomizes the fuel by collapse energy of air bubbles in the fuel after the injection.

As described above, various approaches have been suggested for fuel injection nozzles and fuel injection valves.

PRIOR ART DOCUMENT

Patent Document

[Patent Document 1] Japanese Patent Application Publication No. 10-141183

[Patent Document 2] Japanese Patent Application Publication No. 2006-177174

SUMMARY OF THE INVENTION

Problems to be Solved by the Invention

Considering various installation manners of a fuel injection valve to a combustion chamber, the fuel injection valve is desired to have a high degree of freedom for a fuel injection direction. For example, a so-called side injection valve is desired to have a lateral fuel injection direction.

However, the injection aperture in the fuel injection nozzle disclosed in Patent Document 1 coincides with a sliding direction of the needle, and accordingly, has a difficulty in injecting fuel to a desired direction.

Therefore, the present invention aims to inject fuel to a desired direction while atomizing fuel.

Means for Solving the Problems

To solve the above described problems, a fuel injection valve disclosed in the present specification is characterized by including: a nozzle body including an injection aperture; a needle that is slidably located in the nozzle body, forms a fuel introduction path between the needle and the nozzle body, and is seated on a seat portion in the nozzle body; a swirling flow generating portion that is located more upstream than the seat portion, and imparts a swirl with respect to a sliding direction of the needle to fuel introduced from the fuel introduction path; a swirl velocity increasing portion that is located more downstream than the seat portion, and increases a swirl velocity of a swirling flow generated in the swirling flow generating portion; and an air bubble reserving portion that is located more downstream than the swirl velocity increasing portion, and reserves air bubbles generated by passage through the swirl velocity increasing portion, wherein the injection aperture opens in the air bubble reserving portion.

An air plume can be produced at a center portion of a swirling flow by increasing a speed of the swirling flow of fuel. Fine air bubbles are generated at a boundary between the produced air plume and the fuel. The generated fine air bubbles are injected from the injection aperture, and then burst and atomize fuel spray. As described above, the spray fuel is atomized. The generated air bubbles in the nozzle body are temporarily reserved in the air bubble reserving portion. The injection aperture has only to open in the air bubble reserving portion, and can be directed toward a desired location, and thus the degree of freedom for the fuel injection direction is high. That is to say, an axis of the injection aperture (injection aperture axis) can be displaced from the sliding direction of the needle (sliding axis extending in the sliding direction), and thus the degree of freedom for the fuel injection direction becomes high.

The injection aperture preferably opens in a region including a farthest point from a sliding axis of the needle in the air bubble reserving portion. The air bubbles temporarily reserved in the air bubble reserving portion swirl in the air bubble reserving portion to separate in accordance with their air bubble diameters. That is to say, air bubbles with a large diameter concentrate in a center portion of the air bubble reserving portion, and air bubbles with a small diameter are forced outside the air bubble reserving portion. The injection aperture opening in an area in which air bubbles with a small diameter concentrate allows to inject fine air bubbles with a small diameter and atomize spray.

When a first edge portion and a second edge portion of the injection aperture are presented in a cross section including a sliding axis of the needle and an axis of the injection aperture, the first edge portion may coincide with a farthest point from the sliding axis of the needle in the air bubble reserving portion, and the second edge portion is located at a side of the sliding axis more than the first edge portion.

A velocity distribution of a swirling flow in the air bubble reserving portion varies in accordance with a distance from the sliding axis of the needle. Thus, the injection aperture opening across regions having the swirling flow with different speed allows to generate a swirling flow in the injection aperture. That is to say, the speed of fuel flowing into the injection aperture becomes non-uniform in accordance with positions of the edge portions of the opening portion, and thereby, the swirling flow is generated by the fuel flowing into the injection aperture. When the swirling flow is generated in the injection aperture, the spray angle widens because of the centrifugal force thereof. When the spray angle widens, the layer of the fuel including the injected air bubbles closely-spaced becomes thinner, and the separation of the fuel thereafter is promoted.

The injection aperture may include at least one of a forward direction injection aperture that extends in a direction along a swirl direction of a swirling flow generated in the swirling flow generating portion, a backward direction injection aperture that extends in a direction counter to the swirl direction of the swirling flow, and an intersecting direction injection aperture that extends in a direction intersecting with the swirl direction of the swirling flow.

The forward direction injection aperture enhances a penetration force by a dynamic pressure of the swirling flow of fuel. The penetration force of the spray injected from the backward direction injection aperture is reduced. The penetration force of the spray injected from the intersecting direction injection aperture can be made to be between those of the spray by the forward direction injection aperture and the spray by the backward direction injection aperture.

The fuel injection valve disclosed in the present specification may further include a gas introduction hole that introduces burnt gas in a combustion chamber toward the swirl velocity increasing portion.

To generate the swirling flow of fuel in the fuel injection valve and generate air bubbles efficiently, gas is supplied into, preferably, the fuel injection valve, especially toward the swirl velocity increasing portion. Although a gas supply passage can be located in the needle in order to introduce gas into the fuel injection valve, the structure may become complicating. Thus, air bubbles can be generated efficiently with a simple structure by introducing burnt gas in the combustion chamber into the fuel injection valve.

The gas introduction hole may be formed in a porous cylindrical member mounted on to the nozzle body. Passage of gas through the porous member allows to generate air bubbles of fuel efficiently. This allows to generate a large amount of air bubbles and mix them into the fuel.

The needle may include an air reserve chamber in a position facing the gas introduction hole. The swirling fuel generates a negative pressure and forms an air plume. Then, air bubbles can be generated at a boundary surface of the produced air plume, i.e. at a boundary between gas and fuel. The air reserve chamber merges burnt gas introduced from the gas introduction hole with gas in the air reserve chamber, and elongates the air plume. The elongated air plume increases an area of the boundary surface in accordance with the elongated amount, and thus allows to increase the generation amount of air bubbles.

Effects of the Invention

The fuel injection valve disclosed in the present specification configures an injection aperture to open in an air bubble reserving portion, and thus can increase a degree of freedom for a fuel injection direction.

BRIEF DESCRIPTION OF THE DRAWINGS

FIG. 3A illustrates an opened state of the valve, and FIG. 3B is a diagram illustrating a bottom view;

FIG. 6A is a diagram illustrating an opened state of the valve, and FIG. 6B is a bottom view;

FIG. 7A is a diagram illustrating an opened state of the valve, and FIG. 7B is a bottom view;

FIG. 8A illustrates an opened state of the valve with a cross sectional view taken along line B-B in FIG. 8B, and FIG. 8B is a bottom view.

MODES FOR CARRYING OUT THE INVENTION

Figure 1:
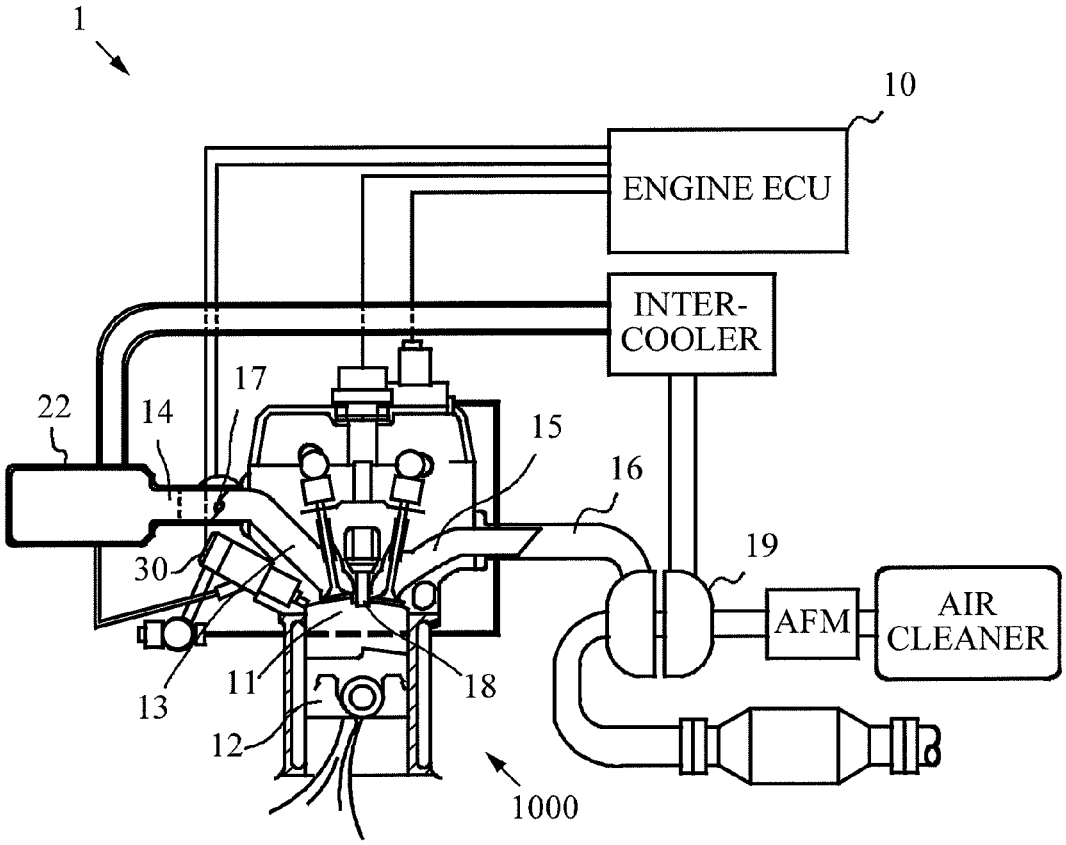
FIG. 1 is an explanatory diagram illustrating a configuration of an engine system to which a fuel injection valve of an embodiment is installed.

Hereinafter, a description will be given of embodiments of the present invention with reference to drawings. However, in the drawings, dimensions of each portion, ratios, and the like may fail to be illustrated so as to correspond to actual ones. Moreover, in some drawings, detail illustration is omitted.

First Embodiment

A description will now be given of a first embodiment of the present invention with reference to drawings. FIG. 1 is a diagram illustrating a configuration of an engine system 1 to which a fuel injection valve 30 of the present invention is installed. FIG. 1 illustrates only a part of the components of an engine 1000.

The engine system 1 illustrated in FIG. 1 includes the engine 1000 that is a power source, and an engine ECU (Electronic Control Unit) 10 that overall controls operation of the engine 1000. The engine system 1 includes fuel injection valves 30 that inject fuel into combustion chambers 11 of the engine 1000. The engine ECU 10 has a function as a controller. The engine ECU 10 is a computer including a CPU (Central Processing Unit) that performs arithmetic processing, a ROM (Read Only Memory) that stores programs and the like, and a RAM (Random Access Memory) or NVRAM (Non Volatile RAM) that stores data and the like.

The engine 1000 is an engine mounted on a vehicle, and includes pistons 12 constituting the combustion chambers 11. The pistons 12 are slidably fitted into cylinders of the engine 1000. The pistons 12 are connected to a crankshaft, which is an output shaft member, via connecting rods.

Intake air coming from an intake port 13 into the combustion chamber 11 is compressed in the combustion chamber 11 by upward motion of the piston 12. The engine ECU 10 determines a fuel injection timing based on a position of the piston 12 from a crank angle sensor and information about a camshaft rotational phase from an intake cam angle sensor, and transmits a signal to the fuel injection valve 30. The fuel injection valve 30 injects fuel at the instructed injection timing according to the signal from the engine ECU 10. The fuel injected from the fuel injection valve 30 is atomized and mixed with the compressed intake air. The fuel mixed with the intake air is then ignited by a spark plug 18 to combust, expands the combustion chamber 11, and lowers the piston 12. This downward motion is converted into the rotation of the crankshaft via the connecting rod to power the engine 1000.

Connected to each of the combustion chamber 11 are the intake port 13 communicating with the combustion chamber 11, and an intake passage 14 connected to the intake port 13 and introducing the intake air from the intake port 13 into the combustion chamber 11. Further, connected to the combustion chamber 11 of each cylinder are an exhaust port 15 communicating with the combustion chamber 11, and an exhaust passage 16 guiding the exhaust gas generated in the combustion chamber to the outside of the engine 1000. A surge tank 22 is located in the intake passage 14.

An air flow meter, a throttle valve 17, and a throttle position sensor are located in the intake passage 14. The air flow meter and the throttle position sensor detect a quantity of the intake air passing through the intake passage 14 and an opening degree of the throttle valve 17 respectively, and transmit detection results to the engine ECU 10. The engine ECU 10 recognizes the quantity of the intake air introduced to the intake port 13 and the combustion chamber 11 based on the transmitted detection results, and controls the opening degree of the throttle valve 17 to adjust the intake air quantity.

A turbocharger 19 is located in the exhaust passage 16. The turbocharger 19 rotates a turbine using kinetic energy of the exhaust gas flowing through the exhaust passage 16, and compresses the intake air that has passed through an air cleaner, and pumps it to an intercooler. The compressed intake air is cooled in the intercooler, and then temporarily reserved in the surge tank 22 before introduced into the intake passage 14. In this case, the engine 1000 is not limited to an engine with a supercharger that includes the turbocharger 19, and may be a natural aspiration engine.

The piston 12 has a cavity at the top thereof. The cavity has a wall surface formed so as to continuously smoothly curve from a direction of the fuel injection valve 30 to a direction of the spark plug 18, and guides the fuel injected from the fuel injection valve 30 to near the spark plug 18 along the shape of the wall surface. In this case, the piston 12 may have a cavity formed at an arbitrary position so as to have an arbitrary shape in accordance with the specification of the engine 1000 as a piston of a re-entrant type combustion chamber has a toric cavity formed in the center portion of the top thereof.

The fuel injection valve 30 is mounted on to the combustion chamber 11 located below the intake port 13. The fuel injection valve 30 directly injects fuel, which is supplied at a high pressure from a fuel pump through a fuel passage, from an injection aperture 33 located at a tip portion of a nozzle body 31 into the combustion chamber 11 based on the instruction from the engine ECU 10. The injected fuel is atomized in the combustion chamber 11, and introduced to near the spark plug 18 along the shape of the cavity while being mixed with the intake air. Leak fuel of the fuel injection valve 30 is returned to a fuel tank from a relief valve through a relief pipe.

The fuel injection valve 30 can be located, not limited to below the intake port 13, in an arbitrary position in the combustion chamber 11. For example, it may be located so that it injects fuel from above the center of the combustion chamber 11.

The engine 1000 may be any one of a gasoline engine fueled by gasoline, a diesel engine fueled by light oil, and a flexible fuel engine using fuel formed by mixing gasoline and alcohol at an arbitrary ratio. Moreover, it may be an engine using any fuel that can be injected by the fuel injection valve. The engine system 1 may be a hybrid system combining the engine 1000 and two or more electric motors.

Figure 2:
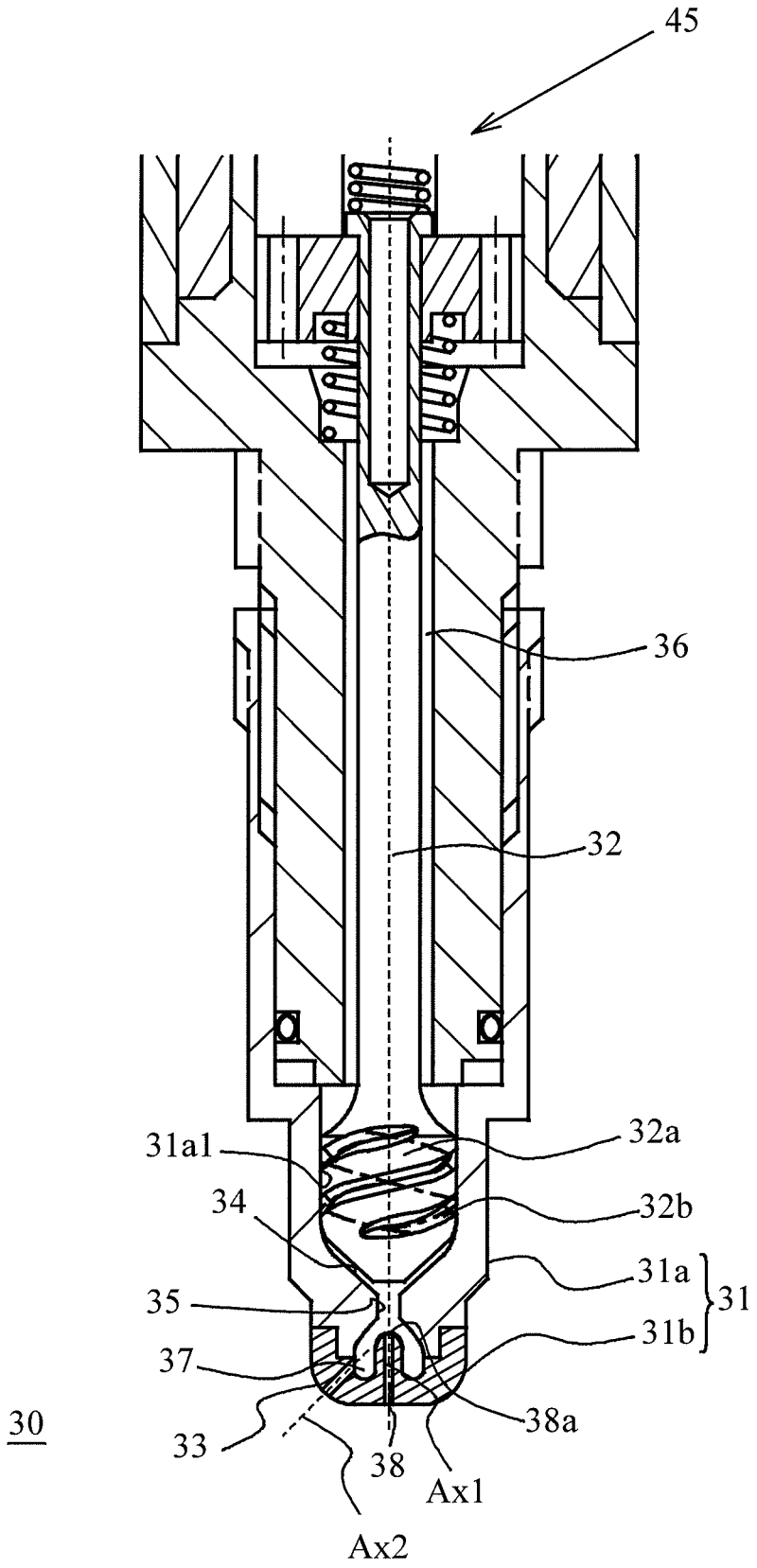
FIG. 2 is an explanatory diagram illustrating a cross section of a main part of the fuel injection valve.
Figure 3A:
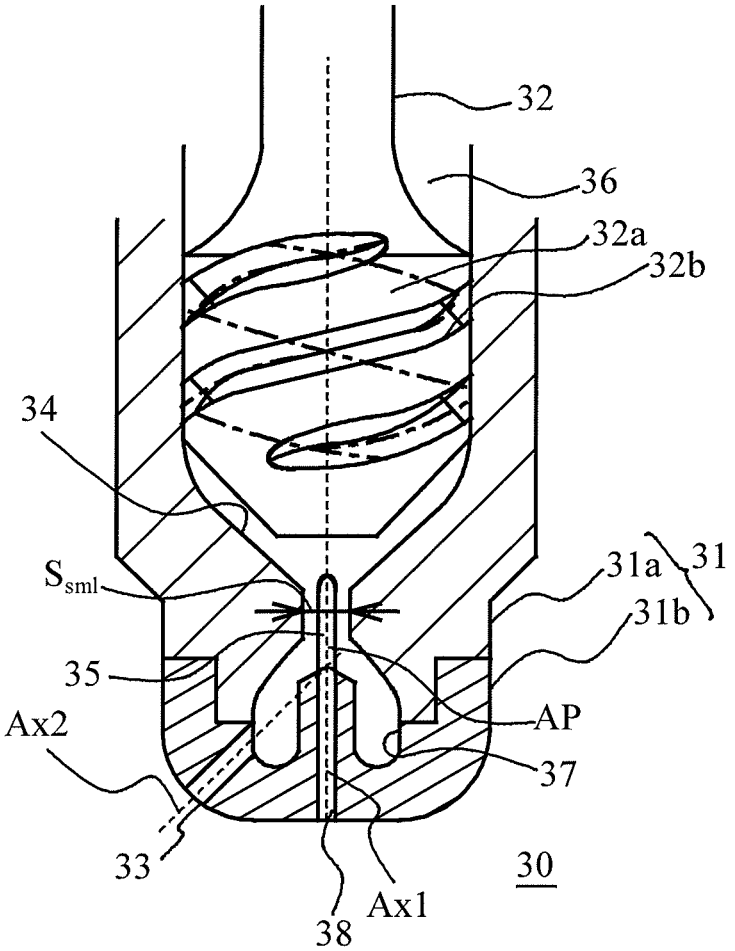
FIGS. 3A and 3B are explanatory diagrams illustrating a tip portion of the fuel injection valve of the embodiment.
Figure 3B:
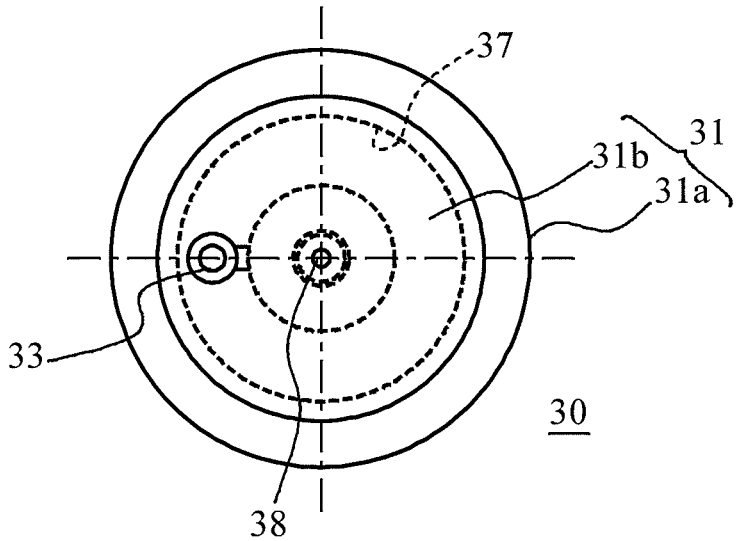
Figure 4:
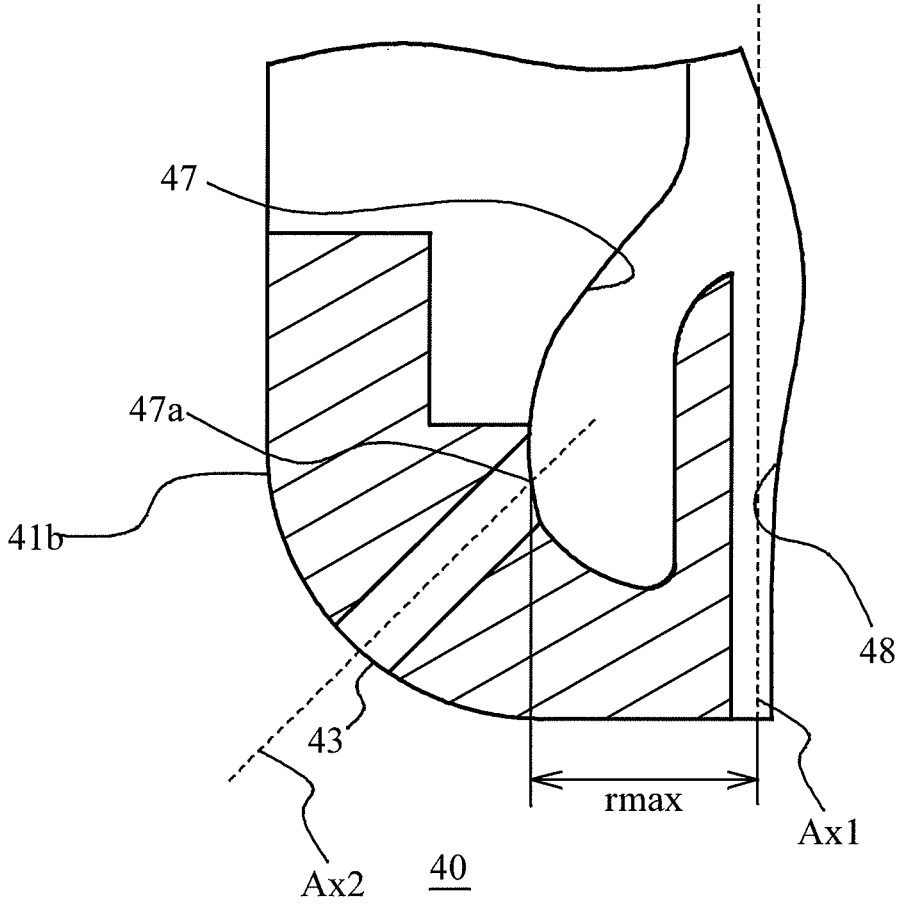
FIG. 4 is an explanatory diagram illustrating an outermost portion of an air bubble reserving portion.

A detail description will next be given of an internal configuration of the fuel injection valve 30 of the embodiment of the present invention. FIG. 2 is an explanatory diagram illustrating a cross-section of a main part of the fuel injection valve 30 of the first embodiment. FIGS. 3A and 3B are explanatory diagrams illustrating a tip portion of the fuel injection valve of the embodiment, FIG. 3A is a diagram illustrating an opened state of the valve, and FIG. 3B is a diagram illustrating a bottom view. FIG. 4 is an explanatory diagram illustrating an outermost portion of an air bubble reserving portion 47.

The fuel injection valve 30 includes the nozzle body 31, a needle 32, and a drive mechanism 45. The drive mechanism 45 controls a sliding motion of the needle 32. The drive mechanism 45 is a conventionally-known mechanism including appropriate components to operate the needle 32 such as actuator using a piezoelectric element, an electric magnet, or the like, and an elastic member that applies an appropriate pressure to the needle 32. Hereinafter, a tip side means a downside of the drawings, and a base end side means an upside of the drawings.

The nozzle body 31 can be divided into a main body portion 31*a* and a nozzle plate 31*b* mounted on a tip portion thereof. The injection aperture 33 is located in the tip portion of the nozzle body 31, more specifically, in the nozzle plate 31*b*. The injection aperture 33 is drilled along an injection aperture axis Ax2 intersecting with a sliding axis Ax1 of the needle 32. A seat portion 34 on which the needle 32 is seated is formed inside the nozzle body 31. The needle 32 is slidably located in the nozzle body 31 to form a fuel introduction path 36 between it and the nozzle body 31, and seated on the seat portion 34 in the nozzle body 31 to cause the fuel injection valve 30 to be in a closed state of the valve as illustrated in FIG. 3B. The needle 32 is lifted upward by the drive mechanism 45, and separates from the seat portion 34 to cause an opened state of the valve. The seat portion 34 is located in a position back from the injection aperture 33.

The fuel injection valve 30 includes a swirling flow generation portion 32*a* that is located more upstream than the seat portion 34, and imparts a swirl with respect to a direction along the sliding axis Ax1 of the needle 32 (sliding direction) to the fuel introduced from the fuel introduction path 36. The swirling flow generation portion 32*a* is located in the tip portion of the needle 32. The swirling flow generation portion 32*a* has a greater diameter than that at the base end side of the needle 32. The tip portion of the swirling flow generation portion 32*a* is seated on the seat portion 34. As described above, the swirling flow generation portion 32*a* is located more upstream than the seat portion 34 in the opened state and the closed state.

The swirling flow generation portion 32*a* has a spiral groove 32*b*. Passage of the fuel introduced from the fuel introduction path 36 through the spiral groove 32*b* imparts a swirl to the flow of fuel, and generates a swirling flow of fuel.

The fuel injection valve 30 includes a swirl velocity increasing portion 35 that is located more downstream than the seat portion 34, and increases a swirl velocity of the swirling flow generated in the swirling flow generation portion 32*a*. The swirl velocity increasing portion 35 is formed so that an inner diameter decreases toward a most narrowed part located more downstream than the seat portion 34. Here, the most narrowed part corresponds to a position at which the inner diameter is least in a part located more downstream than the seat portion 34.

The fuel injection valve 30 includes a gas introduction hole 38 that introduces burnt gas in the combustion chamber 11 toward the swirl velocity increasing portion 35. More specifically, a raised cylindrical portion extending toward the swirl velocity increasing portion 35 is located in the nozzle plate 31*b*, and the gas introduction hole 38 is located in the inside of the cylindrical portion. The gas introduction hole 38 includes an opening portion 38*a* facing the swirl velocity increasing portion 35. As described above, the fuel injection valve in the present embodiment does not need to include an extra structure for introducing gas into the fuel injection valve 30 to form an air plume AP, and thus has a simple structure and also has an advantage in cost.

The swirl velocity increasing portion 35 is formed between the seat portion 34 and the injection aperture 33, and increases the swirl velocity of the fuel that passes through the swirling flow generation portion 32*a* and becomes in a swirling state. The swirl velocity increasing portion 35 gradually narrows a swirl radius of the swirling flow generated in the swirling flow generation portion 32*a*. The swirling flow flowing into a narrow region in which the diameter is decreased increases its swirl velocity. The swirling flow with the increased swirl velocity forms the air plume AP as illustrated in FIG. 3A. The swirling flow accelerates in the swirl velocity increasing portion 35, and a negative pressure is generated at a swirl center of the strong swirling flow to form the air plume AP. When the negative pressure is generated, air outside the nozzle body 31 is proactively inhaled into the nozzle body 31 through the gas introduction hole 38. As a result, the air plume AP is stably produced in the nozzle body 31. Air bubbles are generated at a boundary face between the produced air plume AP and the fuel. Produced air bubbles are temporarily reserved in an air bubble reserving portion 37 described later, and then injected from the injection aperture 33.

The fuel injection valve 30 includes the air bubble reserving portion 37 that is located more downstream than the swirl velocity increasing portion 35 and reserves air bubbles generated by passage through the swirl velocity increasing portion 35. The air bubble reserving portion 37 has a wall surface parallel to the sliding axis Ax1. The wall surface includes a farthest point from the sliding axis Ax1. In addition, the injection aperture 33 opens in a region including the farthest point from the sliding axis Ax1 of the needle 32 in the air bubble reserving portion 37. The fuel continues to swirl in the air bubble reserving portion 37. The air bubbles temporarily reserved in the air bubble reserving portion 37 swirl in the air bubble reserving portion 37 to separate in accordance with their air bubble diameters. That is to say, air bubbles with a large diameter concentrate in the center portion of the air bubble reserving portion 37, and air bubbles with a small diameter are forced outside the air bubble reserving portion 37. The injection aperture 33 opening in a region in which air bubbles with a small diameter concentrate allows to inject fine air bubbles with a small diameter and atomize spray.

The fuel injection valve 30 of the present embodiment allows a wide spray angle by the centrifugal force of the swirling flow of fuel. This can promote the mixing with the air. Moreover, since the spray includes air bubbles, i.e. compressible gas, a critical velocity (sonic velocity) at which sound propagates becomes slow. The flow rate of fuel slows as the sonic velocity slows because of physics that the flow rate of fuel cannot exceed the sonic velocity. If the flow rate of fuel slows, penetration decreases, and oil dilution at a bore wall is suppressed. In addition, when the flow rate of fuel slows because of the inclusion of air bubbles, a diameter of the injection aperture is configured to be large to ensure the same fuel injection. Deposits accumulate at the injection aperture. The accumulation of deposits changes an injection quantity. However, if the diameter of the injection aperture is configured to be large and the injection quantity is large, sensitivity to a change in injection quantity due to the accumulation of deposits (change amount of injection quantity) decreases. That is to say, a ratio of the change amount of injection quantity to the injection quantity decreases, and thus the effect of the change in injection quantity due to the accumulation of deposits becomes smaller.

In addition, the fuel injection valve 30 gradually decreases a swirl radius by the swirl velocity increasing portion 35, and thus the air plume AP is stably produced. The stable production of the air plume AP reduces variations in air bubble diameter of fine air bubbles generated at the boundary face of the air plume AP. In addition, fluctuation of fuel including fine air bubbles is suppressed. As a result, a particle size distribution of fuel particles formed by the crush (burst) of the injected fine air bubbles is reduced, and homogeneous spray can be obtained. Moreover, the stable formation of the air plume AP allows to obtain the spray having small variation in particle size of fuel between cycles of the engine 1000. These contribute to a reduction of PM, a reduction of HC, and improvement of thermal efficiency. Further, stable operation with less combustion fluctuation of the engine 1000 becomes possible, and thus fuel efficiency can be improved, toxic exhaust gases can be reduced, EGR (Exhaust Gas Recirculation) can be increased, and an A/F (air-fuel ratio) can be made leaner.

The fuel injection valve 30 configured as described above has the following advantages. First, burnt gas is introduced from the inside of the combustion chamber 11, and thus an extensive structure for introducing gas into the nozzle body 31 is unnecessary. In addition, the most narrowed part is the swirl velocity increasing portion 35 provided separately from the injection aperture 33, and thus a minimum swirl radius can be determined separately from a diameter of the injection aperture. That is to say, the swirl velocity increasing portion 35 is provided separately from the injection aperture 33 of which a diameter is affected by requirements such as the injection quantity, and thus, a degree of freedom for setting a diameter of the most narrowed part and a minimum swirl radius increases. The minimum swirl radius affects a whirl frequency that affects a diameter of a generated air bubble. Increase in a degree of freedom for setting the minimum swirl radius allows the whirl frequency to be adjusted with respect to each engine, and thus spray characteristics appropriate to respective engines can be obtained. For example, in a case of the engine 1000 having a small bore diameter, a diameter of the swirl velocity increasing portion 35 (most narrowed diameter Ssm1) is configured to be smaller to make a diameter of a generated air bubble small. This can shorten a time that elapses before air bubbles crush, and cause air bubbles to collapse before the air bubbles crash against the bore wall. As a result, the oil dilution at the bore wall is suppressed. On the other hand, in a case of the engine 1000 having a large bore diameter, a diameter of the swirl velocity increasing portion 35 (most narrowed diameter Ssm1) is configured to be larger to make the diameter of the generated air bubble diameter large. This elongates the time that elapses before air bubbles crush, and increase the penetration. As a result, spray can be extensively distributed in the combustion chamber 11, and homogenization of the air-fuel mixture can be achieved. Further, a degree of freedom for setting the injection direction is high because the injection aperture 33 can be made to open in the air bubble reserving portion 37. Therefore, the degree of freedom for a mounting position and mounting angle of the fuel injection valve 30 is high, and applicability is high.

As described above, air bubbles can be easily caused to burst at a desired timing after the injection, and thus the fuel spray can be super-atomized, and vaporization of fuel can be promoted. The promotion of the vaporization of fuel can reduce PM (Particulate Matter), reduce HC (hydrocarbon), and improve thermal efficiency. In addition, erosion in the fuel injection valve 30 can be suppressed.

Further, a seat diameter of the seat portion 34 on which the needle 32 is seated can be configured to be small by configuring a narrowed diameter of the swirl velocity increasing portion 35 located downstream of a seat portion 54 to be small. Therefore, a force pushing the needle 32 due to the pressure during combustion of the engine 1000 can be reduced. This allows a mounting weight of the needle 32 for ensuring the fuel seal (closing pressure) when the needle is closed to be small. As a result, a drive of the fuel injection valve 30 becomes easy, and the driving force of the drive mechanism 45 can be reduced, and thus there is an advantage in cost.

FIG. 4 illustrates a tip portion of a fuel injection valve 40 including the air bubble reserving portion 47 instead of the air bubble reserving portion 37. The fuel injection valve 40 includes a nozzle plate 41*b*, an injection aperture 43, and a gas introduction hole 48 as the fuel injection valve 30 does. The air bubble reserving portion 47 of the fuel injection valve 40 has a different shape from that of the air bubble reserving portion 37 of the fuel injection valve 30. The air bubble reserving portion 47 has a shape that bulges at the tip side in contrast to the air bubble reserving portion 37 of which the outside diameter at the tip side has a straight linear shape parallel to the sliding axis Ax1. In the drawing, a reference numeral 47*a* represents a point at which a distance from the sliding axis Ax1 of the needle is farthest, i.e. a position located a distance rmax away from the sliding axis Ax1. The injection aperture 43 opens so as to include the point 47*a*. More specifically, the injection aperture axis Ax2 is configured so as to pass through the point 47*a*. Even when the shapes of air bubble reserving portions are different, fuel including fine air bubbles forced near the wall surface of the air bubble reserving portion can be injected by configuring the injection aperture to open in the region including the farthest point from the sliding axis Ax1.

Second Embodiment

Figure 5:
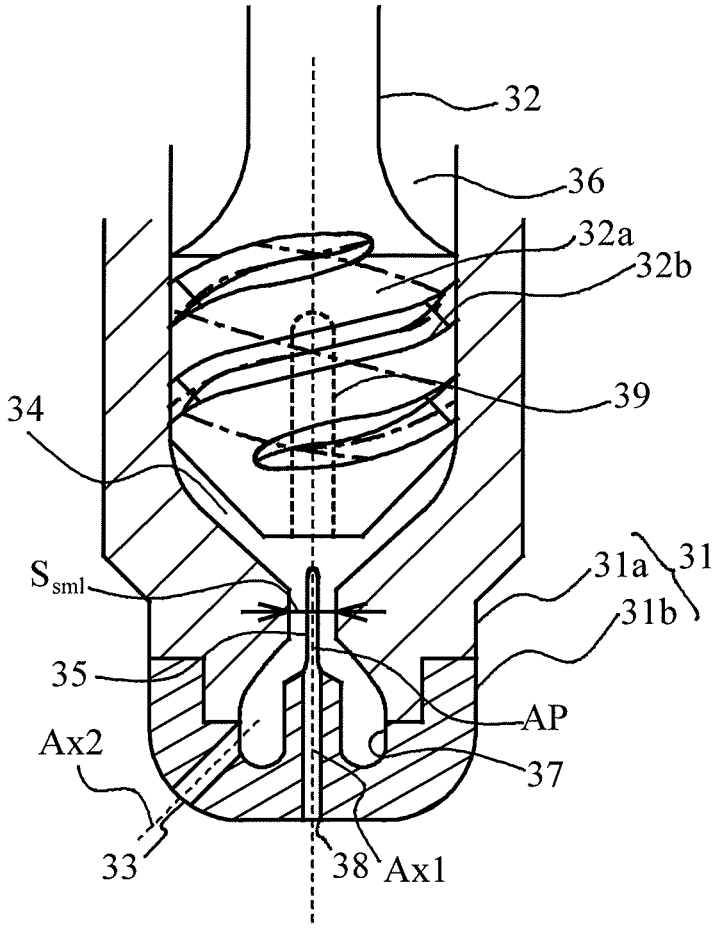
FIG. 5 is an explanatory diagram illustrating a tip portion of another fuel injection valve.

A description will now be given of a second embodiment with reference to FIG. 5 FIGS. 5A and 5B. FIGS. 5A and 5B are explanatory diagrams illustrating a tip portion of the fuel injection valve 30 of the second embodiment. The second embodiment differs from the first embodiment in the following respects. That is to say, the needle 32 of the second embodiment includes an air reserve chamber 39 in a position facing the gas introduction hole 38. Other configuration are the same between the first embodiment and the second embodiment, and thus the same reference numerals are affixed to the common components in the drawing, and a detail description thereof is omitted.

The air reserve chamber 39 is a hollow portion located in the needle 32. The air reserve chamber 39 facing the gas introduction hole 38 allows to obtain the following effect.

A negative pressure generated by the swirling flow in the swirl velocity increasing portion 35 causes burnt gas inhaled from the outside (combustion chamber side) to coalesce with remaining gas in the air reserve chamber 39, and the air plume AP is formed. Thus, a length of the air plume AP increases. This increases an area of the boundary face of the air plume AP, and a generation amount of air bubbles increases. The increase in the generation amount of air bubbles increases a density of air bubbles in the spray, and a film thickness of an air bubble by fuel becomes thinner. The thinner film thickness shortens a time to collapse (time to crush). In addition, a particle size of the spray becomes further smaller and homogenized. This prevents liquid fuel from reaching a top portion of the combustion chamber, and thus knocking is suppressed.

Further, the air plume AP is stably formed. This also reduces and homogenizes a spray particle size distribution. As a result, spray having small variations in particle size of fuel between cycles of the engine 1000 can be obtained. These contribute to a reduction of PM, a reduction of HC, and improvement of thermal efficiency. Further, stable operation with less combustion fluctuation of the engine 1000 becomes possible, and thus fuel efficiency can be improved, toxic exhaust gases can be reduced, EGR (Exhaust Gas Recirculation) can be increased, and an A/F (air-fuel ratio) can be made leaner.

In addition, the air reserve chamber 39, which is a hollow portion, formed in the needle 32 allows to reduce the weight of the needle 32 that is a movable component. The lightened needle 32 can improve the responsiveness of the needle 32. Moreover, an output required of the drive mechanism 45 driving the needle 32 decreases, and thus cost is reduced.

Third Embodiment

Figure 6A:
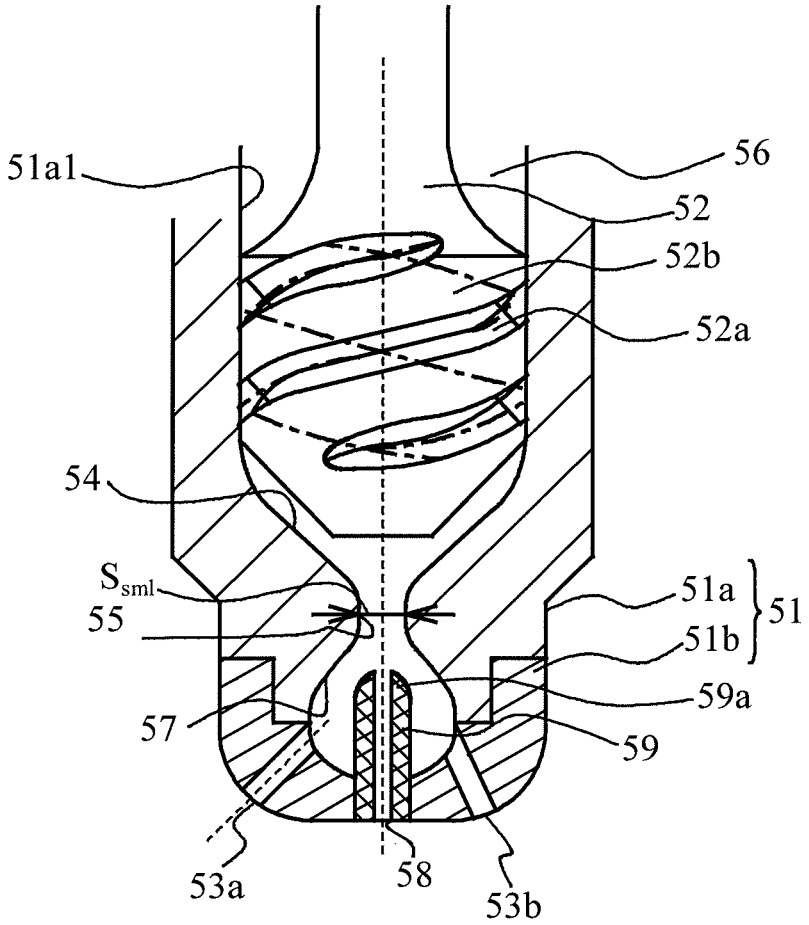
FIGS. 6A and 6B are explanatory diagrams illustrating a tip portion of a fuel injection valve of another embodiment.
Figure 6B:
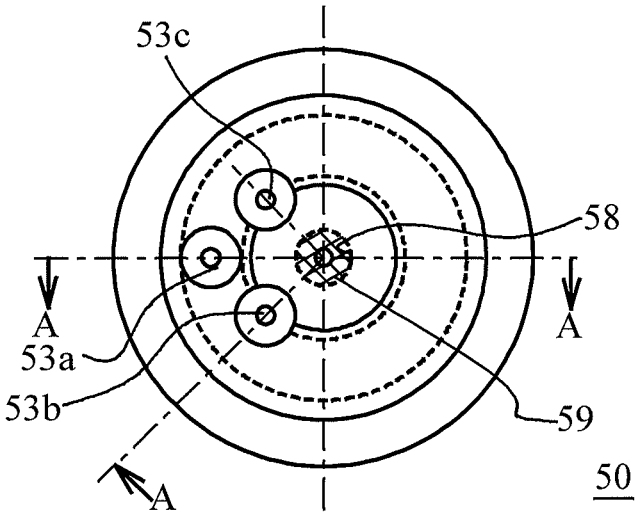

A description will now be give of a third embodiment with reference to FIG. 6 FIGS. 6A and 6B. FIGS. 6A and 6B are explanatory diagrams illustrating a tip portion of a fuel injection valve 50 of the third embodiment, FIG. 6A is a diagram illustrating an opened state of the valve, and FIG. 6B is a bottom view. FIG. 6A is a cross sectional view taken along line A-A in FIG. 6B. A fundamental configuration of the fuel injection valve 50 is in common with that of the fuel injection valve 30 of the first embodiment. That is to say, the fuel injection valve 50 includes a nozzle body 51 including a main body portion 51*a* and a nozzle plate 51*b*, a needle 52, and the seat portion 54. In addition, a fuel introduction path 56 is formed in the fuel injection valve 50. Further, the fuel injection valve 50 includes a swirling flow generating portion 52*a* and a spiral groove 52*b* as the fuel injection valve 30 does. In addition, a swirl velocity increasing portion 55 and an air bubble reserving portion 57 are also included. Further, a gas introduction hole 58 is also included.

The fuel injection valve 50 differs from the fuel injection valve 30 in the following respects. That is to say, the gas introduction hole 58 included in the fuel injection valve 50 is formed in the nozzle body 51, more specifically, in a cylindrical porous member 59 mounted in the nozzle plate 51*b*. The needle 52 may have an air reserve chamber as the second embodiment has. The third embodiment includes injection apertures 53*a* and 53*b*, but may have a single injection aperture as the first embodiment and the second embodiment do.

Provision of the porous member 59 allows to obtain the following effects. That is to say, burnt gas introduced into the porous member 59 from the gas introduction hole 58 located in the porous member 59 passes through microscopic pores of the porous member 59, and is supplied to the fuel swirling outside the porous member 59. Thus, fine air bubbles can be generated efficiently, and fine air bubbles can be mixed in the swirling flow.

An outer dimension of the porous member 59 of the third embodiment is configured to be quarter of a diameter of the air bubble reserving portion or greater. This is because of the following reason. According to experiments, a ratio of the diameter of the air plume AP to that of the injection aperture is approximately 0.12. Generally, gas passing through microscopic pores from the inside of the porous member 59 immediately combines with gas when gas is present outside the porous member 59. Therefore, air bubbles are not formed. To generate air bubbles, liquid needs to be present outside a porous member 59. From this point of view, an outside diameter of the porous member 59 is required to be greater than or equal to the diameter of the air plume AP formed in the air bubble reserving portion 57. Therefore, the outside diameter of the porous member 59 of the third embodiment is configured to be quarter of the diameter of the air bubble reserving portion 57 or greater as the dimension that can satisfy the above described requirement.

Even when fuel is present outside the porous member 59, in a case where the swirl velocity decreases, gasses passing through microscopic pores of the porous member 59 may easily combine with each other. However, it is considered that air bubbles are dispersed into the fuel before gasses combine with each other if the swirling flow is a flow that generates a negative pressure at a swirl center. In addition, ultrafine air bubbles do not deform or unite by crash between air bubbles and mutual interaction with a turbulent airflow as a hard sphere does not. This is confirmed by experiments. Therefore, subject fine air bubbles can be mixed into fuel.

Fourth Embodiment

Figure 7A:
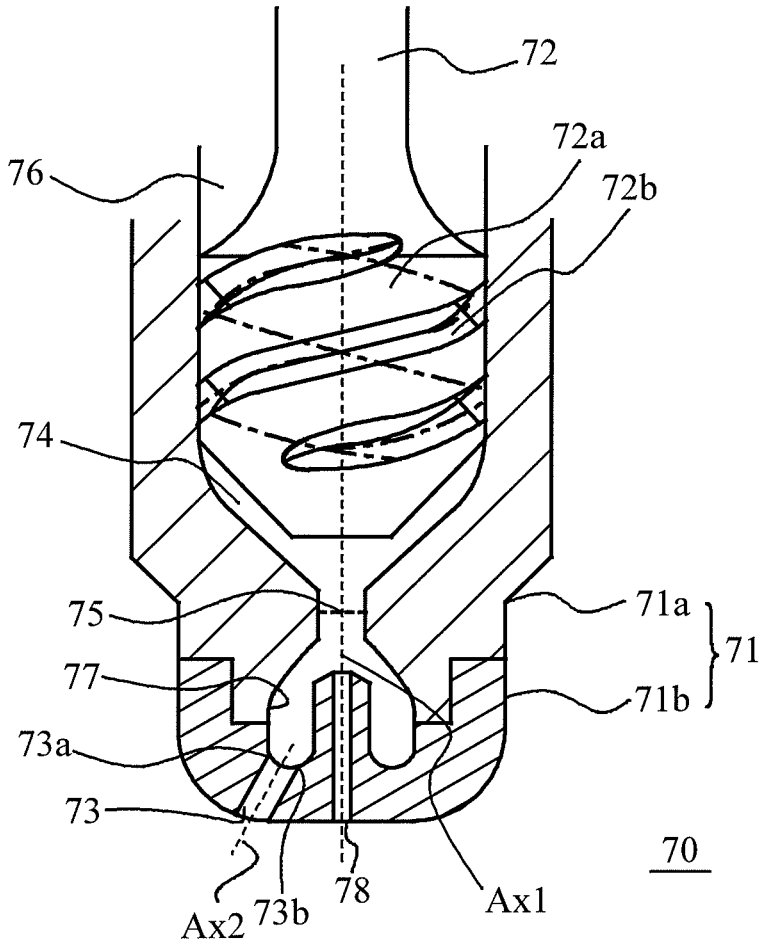
FIGS. 7A and 7B are explanatory diagrams illustrating a tip portion of a fuel injection valve of another embodiment.
Figure 7B:
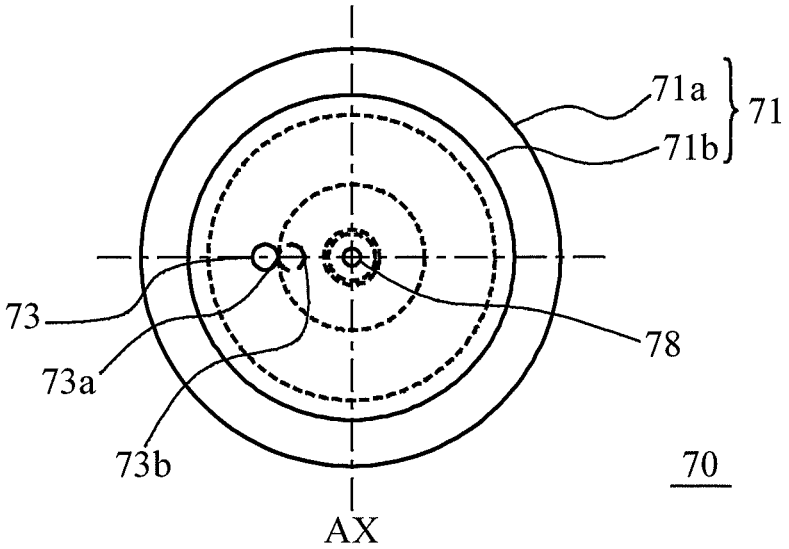

A description will now be given of a fourth embodiment with reference to FIG. 7 FIGS. 7A and 7B. FIGS. 7A and 7B are explanatory diagrams illustrating a tip portion of a fuel injection valve 70 of the fourth embodiment, FIG. 7A is a diagram illustrating an opened state of the valve, and FIG. 7B is a bottom view. A fundamental configuration of the fuel injection valve 70 is in common with that of the fuel injection valve 30 of the first embodiment. That is to say, the fuel injection valve 70 includes a nozzle body 71 including a main body portion 71*a* and a nozzle plate 71*b*, a needle 72, an injection aperture 73, and a seat portion 74. In addition, a fuel introduction path 76 is formed in the fuel injection valve 70. Moreover, the fuel injection valve 70 includes a swirling flow generating portion 72*a* and a spiral groove 72*b* as the fuel injection valve 30 does. Further, an air bubble reserving portion 77 is also included. The fuel injection valve 70 differs from the fuel injection valve 30 in the following respects. The fuel injection valve 70 presents a first edge portion 73*a* and a second edge portion 73*b* of the injection aperture 73 in the cross section including the sliding axis Ax1 of the needle 72 and the injection aperture axis Ax2 of the injection aperture 73. At this point, the first edge portion 73*a* coincides with the farthest point from the sliding axis Ax1 of the needle 72 in the air bubble reserving portion 77. Further, the second edge portion 73*b* is located at the sliding axis Ax1 side more than the first edge portion 73*a*. A swirl velocity near the first edge portion 73*a* differs from a velocity near the second edge portion 73*b*.

Such a relationship between the first edge portion 73*a* and the second edge portion 73*b* allows to obtain the following effects. That is to say, the swirling flow of fuel can be generated in the injection aperture 73. The generated swirling flow can widen the spray angle. Fine air bubbles tend to disperse because of a repulsive force due to charge. On the other hand, however, a surface tension of a liquid film of an air bubble makes air bubbles difficult to separate from each other, slows separation, and varies film thicknesses of air bubbles, and as a result, atomized fuel after air bubbles collapse may become non-uniform and a particle size distribution of fuel may vary. To prevent this, injected fine air bubbles are desired to smoothly individually separate.

Thus, the injection aperture 73 is configured so that the first edge portion 73*a* and the second edge portion 73*b* are located as described above, and thereby fuel having different swirl velocities is injected into the injection aperture 73 to generate the swirling flow in the injection aperture 73. This increases the spray angle by the centrifugal force of the swirling flow and a layer of injected fuel becomes thinner, and thus the surface tension between fine air bubbles is weakened. As a result, fine air bubbles can be smoothly separated.

Fifth Embodiment

Figure 8A:
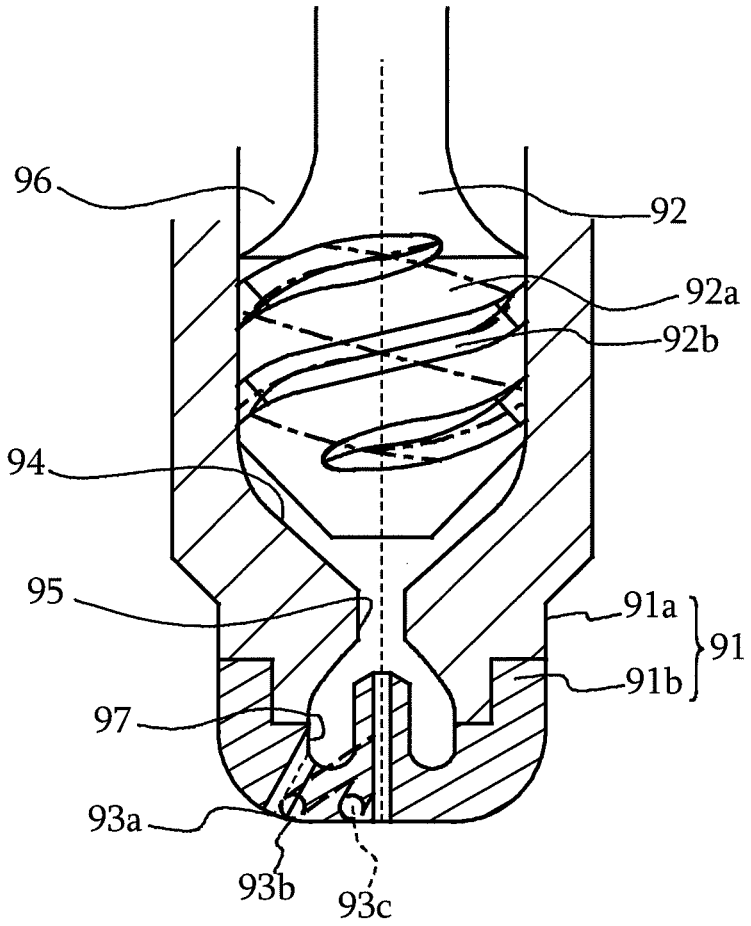
FIGS. 8A and 8B are explanatory diagrams illustrating a tip portion of a fuel injection valve of another embodiment.
Figure 8B:
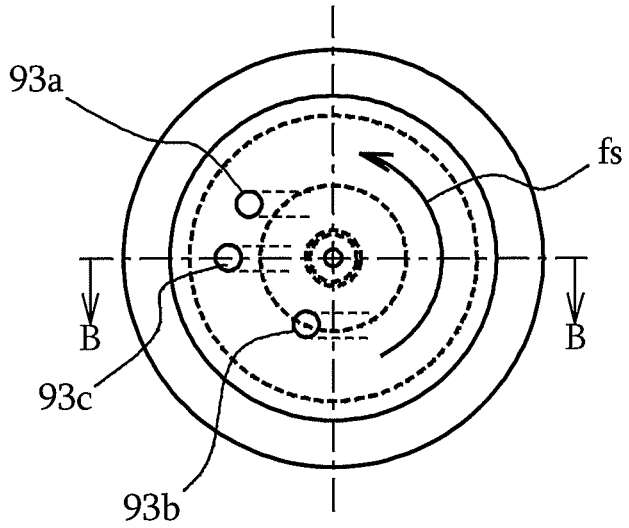

A description will next be given of a fifth embodiment with reference to FIG. 8 FIGS. 8A and 8B. FIGS. 8A and 8B are explanatory diagrams of a tip portion of a fuel injection valve 90 of the fifth embodiment, FIG. 8A illustrates an opened state of the valve with a cross sectional view taken along line B-B in FIG. 8B, and FIG. 8B is a bottom view. A fundamental configuration of the fuel injection valve 90 is in common with the fuel injection valve 30 of the first embodiment. That is to say, the fuel injection valve 90 includes a nozzle body 91, a needle 92, and a seat portion 94. In addition, a fuel introduction path 96 is formed in the fuel injection valve 90. In addition, the fuel injection valve 90 includes a swirling flow generating portion 92*a* and a spiral groove 92*b* as the fuel injection valve 30 does. Moreover, a swirl velocity increasing portion 95 and an air bubble reserving portion 97 are also included. The fuel injection valve 90 differs from the fuel injection valve 30 in the following respects. That is to say, the fuel injection valve 90 includes a forward direction injection aperture 93*a* that extends in a direction along a swirl direction fs of the swirling flow generated in the swirling flow generating portion 92*a*. Further, the fuel injection valve 90 includes a backward direction injection aperture 93*b* that extends in a direction counter to the swirl direction fs of the swirling flow, and an intersecting direction injection aperture 93*c* that extends in a direction intersecting with the swirl direction of the swirling flow.

A speed of spray when injected from the injection aperture is restricted by the sonic velocity of fuel. Thus, when an air-liquid two-phase flow formed by mixing air bubbles with liquid fuel is injected from the injection aperture, the sonic velocity at the void fraction restricts the spray speed. Thus, the fuel injection valve 90 of the fifth embodiment has a slow spray speed as the first through fourth embodiment do. In addition, the particle size of spray is also small, and the penetration of the spray is low.

In contrast, a distance to the bore wall facing the fuel injection valve is far in the engine 1000 having the fuel injection valve mounted in the peripheral portion of the combustion chamber 11 and performs a so-called side injection. While, distances to a top of the piston 12 and to a wall of the combustion chamber 11 are small. In such arrangement, control of the penetration is important to spray fuel evenly in the combustion chamber 11 and achieve homogenization of the air-fuel mixture.

Thus, the forward direction injection aperture 93*a* is used in a case directing to the facing bore wall. The forward direction injection aperture 93*a* can increase the penetration with a dynamic pressure of the swirling flow. On the other hand, in a case close to a top of the piston 12 and a wall of the combustion chamber 11, the backward direction injection aperture 93*b* is used to decrease the penetration so as not to be affected by the dynamic pressure of the swirling flow as much as possible. The decrease of the penetration prevents air bubbles from reaching the top of the piston 12 or the wall of the combustion chamber 11 before they crush, and allows to homogenize the air-fuel mixture while suppressing oil dilution. This can reduce PM and HC.

The intersecting direction injection aperture 93*c* partly receives a dynamic pressure of the swirling flow. Change of the intersecting angle can change the strength of the dynamic pressure, and thereby allows to control the penetration.

The forward direction injection aperture 93*a*, the backward direction injection aperture 93*b*, and the intersecting direction injection aperture 93*c* preferably open so as to include an outermost portion of the air bubble reserving portion 97. This allows to inject fine air bubbles with a small diameter concentrating in the outermost portion of the air bubble reserving portion 97.

Figure 9:
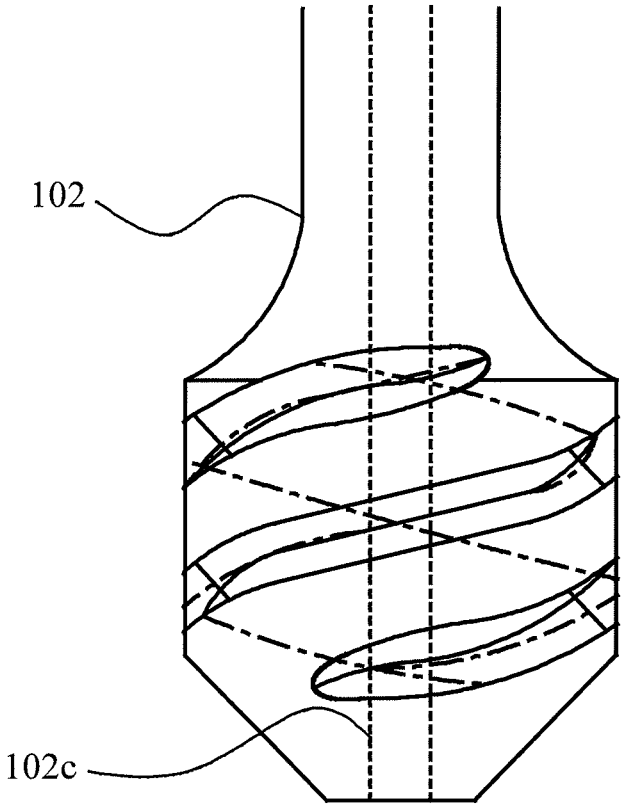
FIG. 9 is an explanatory diagram illustrating a needle of another fuel injection valve.

While the exemplary embodiments of the present invention have been illustrated in detail, the present invention is not limited to the above-mentioned embodiments, and other embodiments, variations and modifications may be made without departing from the scope of the present invention. For example, a needle 102 illustrated in FIG. 9 may be employed. The needle 102 includes a gas passage 102*c* communicating with an outside. The gas passage 102*c* may be located together with or instead of the gas introduction hole 38.

Further, the spiral groove generating the swirling flow may be located not only in the needle, but also in the inner wall of the nozzle body. The spiral groove may be, of course, located only in the inner wall of the nozzle body.

DESCRIPTION OF LETTERS OR NUMERALS

1 engine system
30, 40, 50, 70, 90 fuel injection valve
31, 41,51,71,91 nozzle body
32, 52, 72, 92, 102 needle
32*a*, 52*a*, 72*a*, 92*a* swirling flow generating portion
32*b*, 52*b*, 72*b*, 92*b* spiral groove
38, 58 gas introduction hole
39 air reserve chamber
33, 33*a*, 33*b*, 43, 53*a*, 53*b*, 73, 93 injection aperture
59 porous member
73*a* first edge portion
73*b* second edge portion
93*a* forward direction injection aperture
93*b* backward direction injection aperture
93*c* intersecting direction injection aperture
34, 54, 74, 94 seat portion
35, 55, 75, 95 swirl velocity increasing portion
36, 56, 76, 96 fuel introduction path

The invention claimed is:

1. A fuel injection valve comprising:

a nozzle body including an injection aperture and a nozzle plate mounted on a tip portion of the nozzle body;

a needle that is slidably located in the nozzle body along a sliding axis, forms a fuel introduction path between the needle and the nozzle body, and is seated on a seat portion in the nozzle body;

a swirling flow generating portion that is located more upstream than the seat portion, and imparts a swirl with respect to a sliding direction of the needle to fuel introduced from the fuel introduction path;

a swirl velocity increasing portion that is located more downstream than the seat portion, and increases a swirl velocity of a swirling flow generated in the swirling flow generating portion to produce an air plume, and in which an inner diameter of the nozzle body gradually decreases in a downstream direction to a most narrowed part of the nozzle body;

a raised cylindrical portion that is located in the nozzle plate and extends along the sliding axis toward the swirl velocity increasing portion and faces the needle in a direction of the sliding axis; and an air bubble reserving portion that is located more downstream than the swirl velocity increasing portion and surrounds entirely the raised cylindrical portion, and reserves air bubbles generated by passage through the swirl velocity increasing portion, wherein the injection aperture opens in the air bubble reserving portion and the needle does not go inside the raised cylindrical portion, a gas introduction hole is located inside of the raised cylindrical portion and faces the needle in the direction of the sliding axis and introduces burnt gas in a combustion chamber toward the swirl velocity increasing portion, when a first edge portion and a second edge portion of the injection aperture are presented in a cross section including the sliding axis of the needle and an axis of the injection aperture, the first edge portion coincides with a farthest point from the sliding axis of the needle in the air bubble reserving portion, and the second edge portion is located at a side of the sliding axis nearer than the first edge portion.

2. A fuel injection valve comprising:

a nozzle body including an injection aperture and a nozzle plate mounted on a tip portion of the nozzle body;

a needle that is slidably located in the nozzle body along a sliding axis, forms a fuel introduction path between the needle and the nozzle body, and is seated on a seat portion in the nozzle body;

a swirling flow generating portion that is located more upstream than the seat portion, and imparts a swirl with respect to a sliding direction of the needle to fuel introduced from the fuel introduction path;

a swirl velocity increasing portion that is located more downstream than the seat portion, and increases a swirl velocity of a swirling flow generated in the swirling flow generating portion to produce an air plume, and in which an inner diameter of the nozzle body gradually decreases in a downstream direction to a most narrowed part of the nozzle body;

a cylindrical porous portion that is located in the nozzle plate and extends along the sliding axis toward the swirl velocity increasing portion and faces the needle in a direction of the sliding axis; and an air bubble reserving portion that is located more downstream than the swirl velocity increasing portion and surrounds entirely the cylindrical porous portion, and reserves air bubbles generated by passage through the swirl velocity increasing portion; and a gas introduction hole that introduces burnt gas in a combustion chamber toward the swirl velocity increasing portion, wherein the gas introduction hole is formed in the cylindrical porous portion mounted on to the nozzle plate and faces the needle in the direction of the sliding axis, and the injection aperture opens in the air bubble reserving portion and the needle does not go inside the cylindrical porous portion, when a first edge portion and a second edge portion of the injection aperture are presented in a cross section including the sliding axis of the needle and an axis of the injection aperture, the first edge portion coincides with a farthest point from the sliding axis of the needle in the air bubble reserving portion, and the second edge portion is located at a side of the sliding axis nearer than the first edge portion.

3. The fuel injection valve according to claim 1, wherein the injection aperture opens in a region including a farthest point from the sliding axis of the needle in the air bubble reserving portion.

4. The fuel injection valve according to claim 1, wherein the injection aperture includes at least one of a forward direction injection aperture that extends in a direction along a swirl direction of a swirling flow generated in the swirling flow generating portion, a backward direction injection aperture that extends in a direction counter to the swirl direction of the swirling flow, and an intersecting direction injection aperture that extends in a direction intersecting with the swirl direction of the swirling flow.

5. The fuel injection valve according to claim 1, wherein the injection aperture includes at least one of a backward direction injection aperture that extends in a direction counter to a swirl direction of the swirling flow and an intersecting direction injection aperture that extends in a direction intersecting with the swirl direction of the swirling flow.

6. The fuel injection valve according to claim 1, wherein the cylindrical portion is a cylindrical porous portion and the gas introduction hole is formed in the cylindrical porous portion.

7. The fuel injection valve according to claim 2, wherein an air reserved chamber is formed inside the needle and an opening of the air reserved chamber faces the gas introduction hole.

8. The fuel injection valve according to claim 1, wherein an air reserved chamber is formed inside the needle and an opening of the air reserved chamber faces the gas introduction hole.

9. The fuel injection valve according to claim 2, wherein the injection aperture opens in a region including a farthest point from the sliding axis of the needle in the air bubble reserving portion.

10. The fuel injection valve according to claim 2, wherein the injection aperture includes at least one of a forward direction injection aperture that extends in a direction along a swirl direction of a swirling flow generated in the swirling flow generating portion, a backward direction injection aperture that extends in a direction counter to the swirl direction of the swirling flow, and an intersecting direction injection aperture that extends in a direction intersecting with the swirl direction of the swirling flow.

11. The fuel injection valve according to claim 2, wherein the injection aperture includes at least one of a backward direction injection aperture that extends in a direction counter to a swirl direction of the swirling flow and an intersecting direction injection aperture that extends in a direction intersecting with the swirl direction of the swirling flow.

* * * * *